US011644156B1

(12) United States Patent
Wang et al.

(10) Patent No.: US 11,644,156 B1
(45) Date of Patent: May 9, 2023

(54) MULTI-ANGLE LIGHTING LAMP

(71) Applicant: Dongguan Bixing Lighting Technology Co., Ltd., Dongguan (CN)

(72) Inventors: Wenxing Wang, Dongguan (CN); Dubei Qing, Dongguan (CN)

(73) Assignee: Dongguan Bixing Lighting Technology Co., Ltd., Dongguan (CN)

( * ) Notice: Subject to any disclaimer, the term of this patent is extended or adjusted under 35 U.S.C. 154(b) by 0 days.

(21) Appl. No.: 17/709,928

(22) Filed: Mar. 31, 2022

(30) Foreign Application Priority Data

Dec. 24, 2021 (CN) ..... 202123304820.4

(51) Int. Cl.

| | |
|---|---|
| ***F21K 9/232*** | (2016.01) |
| ***F21V 29/50*** | (2015.01) |
| ***F21V 29/83*** | (2015.01) |
| ***F21V 19/00*** | (2006.01) |
| ***F21V 29/71*** | (2015.01) |
| ***F21V 29/67*** | (2015.01) |
| ***F21V 29/70*** | (2015.01) |

(52) U.S. Cl.
CPC ..... *F21K 9/232* (2016.08); *F21V 19/003* (2013.01); *F21V 19/004* (2013.01); *F21V 19/0045* (2013.01); *F21V 29/50* (2015.01); *F21V 29/67* (2015.01); *F21V 29/70* (2015.01); *F21V 29/71* (2015.01); *F21V 29/713* (2015.01); *F21V 29/83* (2015.01)

(58) Field of Classification Search
CPC ..... F21K 9/232; F21V 29/70; F21V 29/71; F21V 29/713; F21V 19/003; F21V 19/004; F21V 19/0045
See application file for complete search history.

(56) References Cited

U.S. PATENT DOCUMENTS

| | | | | |
|---|---|---|---|---|
| 2005/0168985 | A1* | 8/2005 | Chen | F21V 19/001 362/241 |
| 2009/0116233 | A1* | 5/2009 | Zheng | F21K 9/232 362/234 |
| 2015/0117018 | A1* | 4/2015 | Chen | F21V 17/12 362/294 |
| 2020/0088396 | A1* | 3/2020 | Duan | F21V 29/83 |
| 2021/0222862 | A1* | 7/2021 | Du | F21V 17/16 |

FOREIGN PATENT DOCUMENTS

| | | | |
|---|---|---|---|
| CN | 208011512 U | | 10/2018 |
| CN | 110397857 A | * | 11/2019 |
| CN | 211289788 U | | 8/2020 |
| CN | 212805549 U | | 3/2021 |

* cited by examiner

*Primary Examiner* — William N Harris
(74) *Attorney, Agent, or Firm* — Nitin Kaushik

(57) ABSTRACT

The utility model discloses a multi-angle lighting lamp, which comprises: a lamp holder, a plurality of lamp boards and a plurality of protective covers; a plurality of protective covers are connected to the lamp board one by one, and the protective covers are covered on the lamp beads; there is a heat sink between two adjacent protective covers, and the heat sinks are communicated with the lamp cavity, so that the convection channel can be formed inside the lamp cavity, so that the air flow can directly and effectively blow the heat dissipation part, and then the air flow can better take away the heat of the dissipation part, thus, the heat on the lamp board is effectively discharged through the heat dissipation part, so the overall heat dissipation efficiency of the lamp has been greatly improved.

8 Claims, 6 Drawing Sheets

MULTI-ANGLE LIGHTING LAMP

CROSS-REFERENCE TO RELATED APPLICATIONS

The application claims priority to Chinese patent application No. 202123304820.4, filed on Dec. 24, 2021, the entire contents of which are incorporated herein by reference.

TECHNICAL FIELD

The utility model relates to the field of lamps and lanterns, in particular to a multi-angle lighting lamp.

BACKGROUND

As we all know, the existing lamps and lanterns, usually can only illuminate sufficiently in the direction of where their light source shining out. In order to achieve multi-direction lighting, it is usually necessary to use multiple light sources to illuminate in different directions. However, excessive light sources usually bring higher heat dissipation requirements, and the heat dissipation efficiency of existing lamps is relatively limited, so lamps often fail to work.

SUMMARY

The utility model aims to solve at least one of the technical problems existing in the present art. Therefore, the utility model provides a multi-angle lighting lamp, which can improve the heat dissipation efficiency of the lamp.

A multi-angle lighting lamp in accordance with the first embodiment of the utility model comprises: a lamp holder, a plurality of lamp boards and a plurality of protective covers; a plurality of lamp boards are connected with the lamp holders, and a plurality of lamp boards are situated around the center of the lamp holder and thus forming the lamp cavity, and lamp boards are provided with the lamp bead and heat dissipation part, and the heat dissipation part is bent and extended into the lamp cavity relative to the lamp broad; and a plurality of protective covers are connected to the lamp board one by one, and the protective covers are covered on the lamp beads; there is a heat sink between two adjacent protective covers, and the heat sinks are communicated with the lamp cavity.

The multi-angle lighting lamp in accordance with the embodiment of the utility model has at least the following beneficial effects: after the lamp holder is connected to the scene, the lamp beads on the lamp board will be able to emit light to achieve the lighting effect. The surrounding distribution of multiple light boards relative to the lamp holder enables multiple light boards to cooperate with different directions of the lamp holder to achieve multi-angle lighting effect. And the protective cover can not only protect the lamp bead, but the heat dissipation between the two adjacent protective covers can make the outside air flow pass through the heat dissipation mouth and flow to the lamp cavity, so as to drive the heat of the heat dissipation part through the other heat dissipation mouth, so as to cooling the heat dissipation part.

By setting the heat dissipation part on the lamp board in the lamp cavity, and by configuring the heat dissipation mouth to form a convection channel inside the lamp cavity, the air flow can directly and effectively blow the heat dissipation part, so that the air flow can better take away the heat of the heat dissipation part. Thus, the heat on the lamp board is effectively discharged through the heat dissipation part, so the overall heat dissipation efficiency of the lamps and lanterns will be greatly improved.

According to some embodiments of the utility model, the protective cover is provided with a connecting groove, and the edge of the lamp board is installed in the connecting groove.

According to some embodiments of the utility model, there are two connecting grooves, the junction of the heat dissipation part and the lamp board is provided with a clamping platform, the edge of the lamp board and the clamping platform are connected to the connecting groove one by one.

According to some embodiments of the utility model, the lamp holder is provided with a connecting seat, the connecting seat is provided with a power supply component, the lamp board is connected to the connecting seat, the power supply component and the lamp board are respectively located on both sides of the connecting seat; the lamp board is connected with an electric receiving part, the electric receiving part passes through the receiving seat and is connected with the power supply component.

According to some embodiments of the utility model, the connecting seat is provided with a positioning slot, the lamp board and the heat dissipation part are inserted in the positioning slot, the electric receiving part passes through the positioning slot.

According to some embodiments of the utility model, the connecting seat is connected with a fan, the connecting seat is provided with a hollow position, the fan is located in the lamp cavity.

According to some embodiments of the utility model, the end of the lamp board far from the lamp holder is connected with a base, the base is provided with an air vent, and the lamp holder is provided with a ventilation hole, and the air vent and ventilation hole are connected with the lamp cavity.

According to some embodiments of the utility model, the base is provided with a light source, the base is a light transmission structure; the lamp bead is arranged on the side of the lamp board, and the light source can emit light in the direction to the one side of the lamp board.

According to some embodiments of the utility model, the hollow position, the fan and the center of the air vent are located on the same straight line.

According to some embodiments of the utility model, the end of the lamp board is provided with a bending part, and a screw is arranged between the bending part and the base, and the two are connected by the screw.

Some additional aspects and advantages of the utility model will be given in the following description, and some of them will become apparent from the following description or become known through the practice of the utility model.

DETAILED DESCRIPTION OF THE EMBODIMENTS

In the description of the utility model, unless otherwise expressly defined, the terms such as setting, installation and connection shall be interpreted in a broad sense, and the technical personnel in the technical field can reasonably determine the specific meanings of the above terms in the utility model based on the specific contents of the technical scheme.

Figure 1:
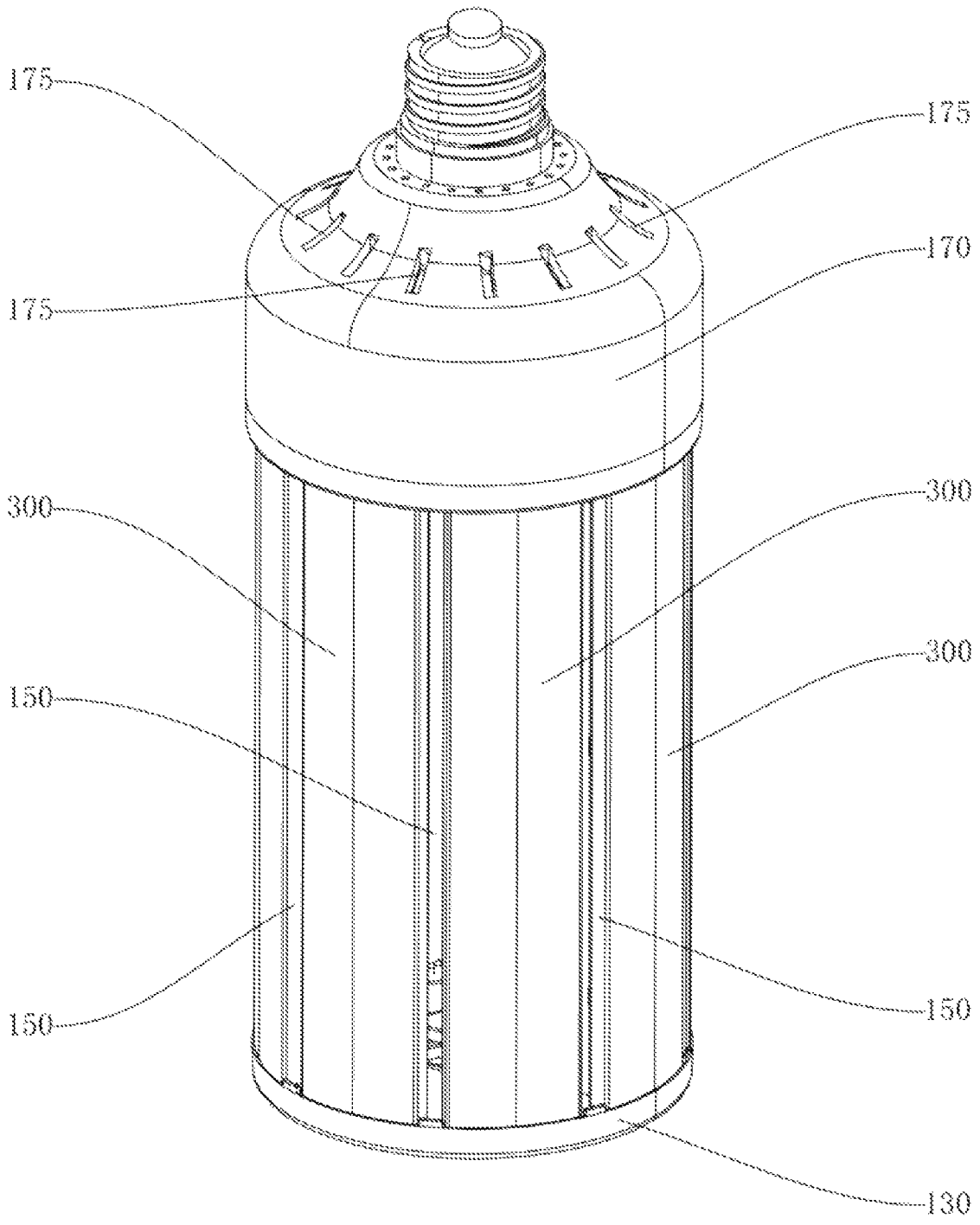
FIG. 1 is a schematic diagram of the multi-angle light lamp of the embodiment of the utility model.

As shown in FIG. 1, a multi-angle lighting lamp, including: lamp holder 170, lamp boards 200 and protective covers 300; a plurality of lamp boards 200 are connected with the lamp holders 170, and a plurality of lamp boards 200 are situated around the center of the lamp holder 170 and thus forming the lamp cavity, and lamp boards 200 are provided with the lamp bead 210 and heat dissipation part 250, and the heat dissipation part 250 is bent and extended into the lamp cavity relative to the lamp broad 200; a plurality of protective covers 300 is connected to the lamp board 200 one by one, and the protective covers 300 are covered on the lamp beads 210; there is a heat sink 150 between two adjacent protective covers 300, and the heat sinks 150 are communicated with the lamp cavity. After the lamp holder 170 is connected to the scene, the lamp beads 210 on the lamp board 200 will be able to emit light to achieve the lighting effect. The surrounding distribution of multiple light boards 200 relative to the lamp holder 170 enables multiple light boards 200 to cooperate with different directions of the lamp holder 170 to achieve multi-angle lighting effect. And the protective cover 300 can not only protect the lamp bead 210, but the heat dissipation 150 between the two adjacent protective covers 300 can make the outside air flow pass through the heat dissipation mouth 150 and flow to the lamp cavity, so as to drive the heat of the heat dissipation part 250 through the other heat dissipation mouth 150, so as to cooling the heat dissipation part 250. By setting the heat dissipation part 250 on the lamp board 200 in the lamp cavity, and by configuring the heat dissipation mouth 150 to form a convection channel inside the lamp cavity, the air flow can directly and effectively blow the heat dissipation part 250, so that the air flow can better take away the heat of the heat dissipation part 250. Thus, the heat on the lamp board 200 is effectively discharged through the heat dissipation part 250, so the overall heat dissipation efficiency of the lamps and lanterns will be greatly improved. Also, multiple hollowed heat dissipation mouth 150 and lamp cavity can greatly reduce the overall weight, thus facilitating the transportation and assembly process.

Specifically, the lamp board 200 and the heat dissipation part 250 cooperate to form an L-shaped structure.

Predictably, the protective cover 300 is a transparent structure, such as transparent plastic or glass. The specific implementation mode can be adjusted accordingly according to actual needs, and there is no restriction here.

Specifically, a threaded tube is arranged on the lamp holder 170, and the lamp holder 170 can be connected and fixed to the external scene by the threaded tube. Predictably, the lamp cap 170 can also be installed and fixed in other ways, such as connecting the bracket (not shown) with screws (not shown), and using the bracket to achieve the installation and fixation with the outside world, etc. The specific implementation mode can be adjusted accordingly according to actual needs, and there is no restriction here.

Specifically, a plurality of heat dissipation mouth 150 are opposite in pairs, and together with the lamp cavity to form a heat dissipation channel, and the heat dissipation part 250 is located in the heat dissipation channel.

Figure 5:
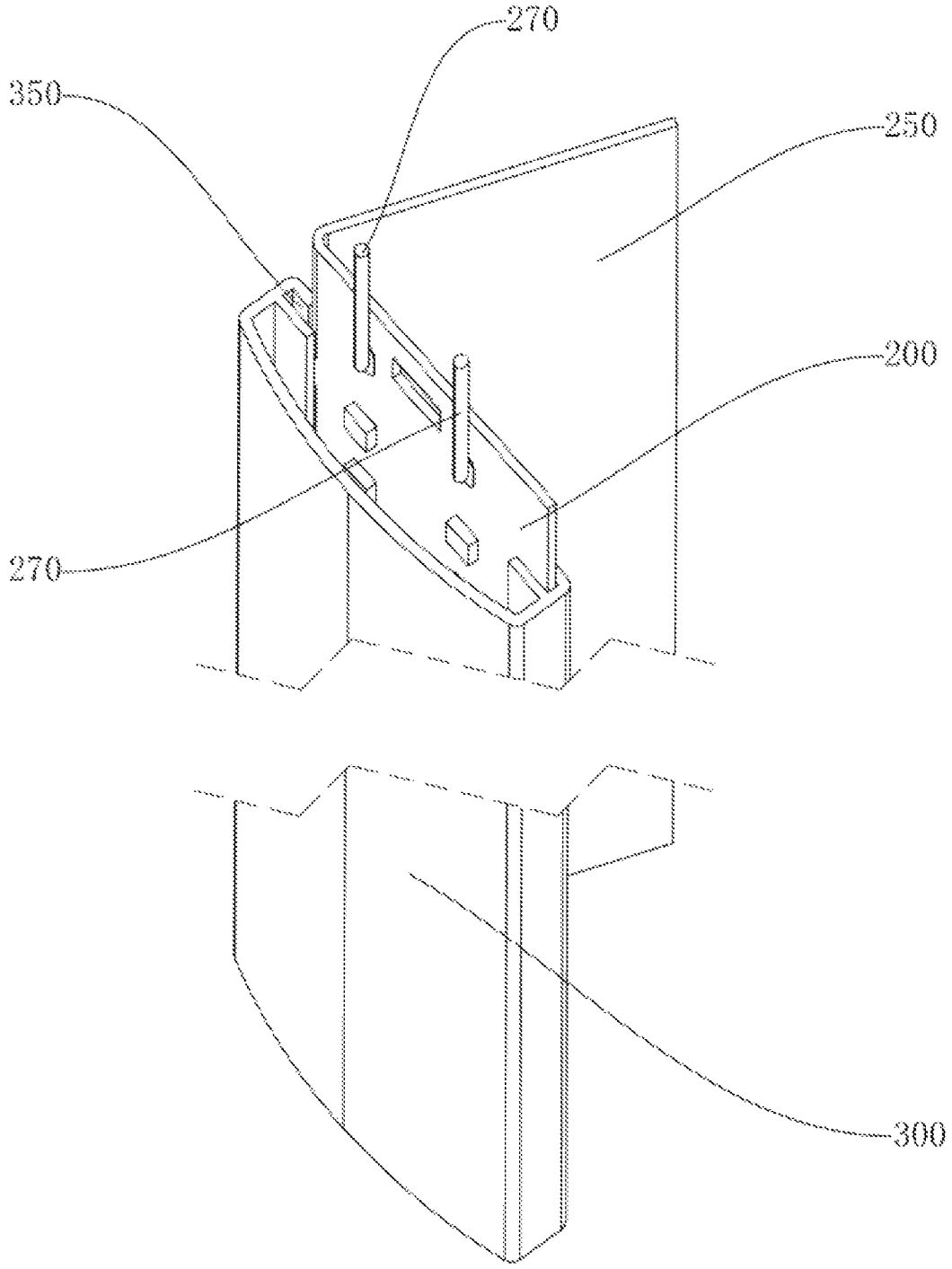
FIG. 5 is a schematic diagram of the protective cover of the multi-angle light lamp shown in FIG. 1.

In some embodiments, referring to FIG. 5, the protective cover 300 is provided with a connecting groove 350, and the edge or the lamp board 200 is installed in the connecting groove 350. The connection groove 350 can be positioned and connected between the protection cover 300 and the lamp board 200, so that the protection cover 300 can be successfully covered on the lamp bead 210, and realize the protection effect on the lamp bead 210.

Figure 6:
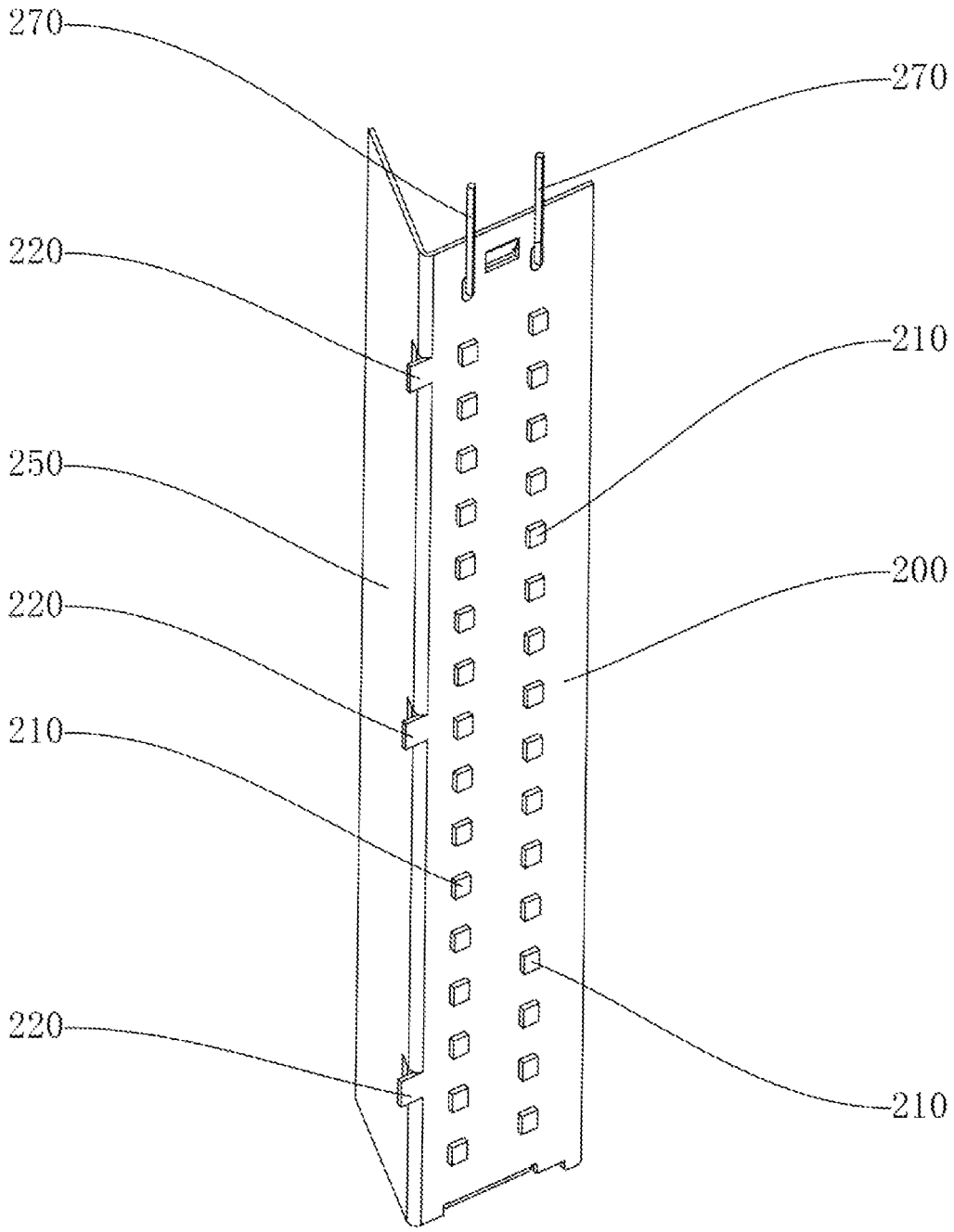
FIG. 6 is a schematic diagram of the light board of multi-angle light shown in FIG. 1.

In some embodiments, referring to FIG. 6, there are two connecting grooves 350, and the junction of the heat dissipation part 250 and the lamp board 200 is provided with clamping platform 220, and the edge of the lamp board 200 and clamping platform 220 are connected in the connecting groove 350 one by one. The two connecting grooves 350 can connect the edges of the clamping platform 220 and the lamp board 200 respectively, so that the connection effect can be achieved on both sides of the lamp board 200, thus avoiding the loose between the protective cover 300 and the lamp board 200. The clamping platform 220 can make the connection between the lamp board 200 and the connecting groove 350 not hindered by the heat dissipation part 250, so as to ensure that the lamp board 200 can be stably connected with the protection cover 300.

Figure 2:
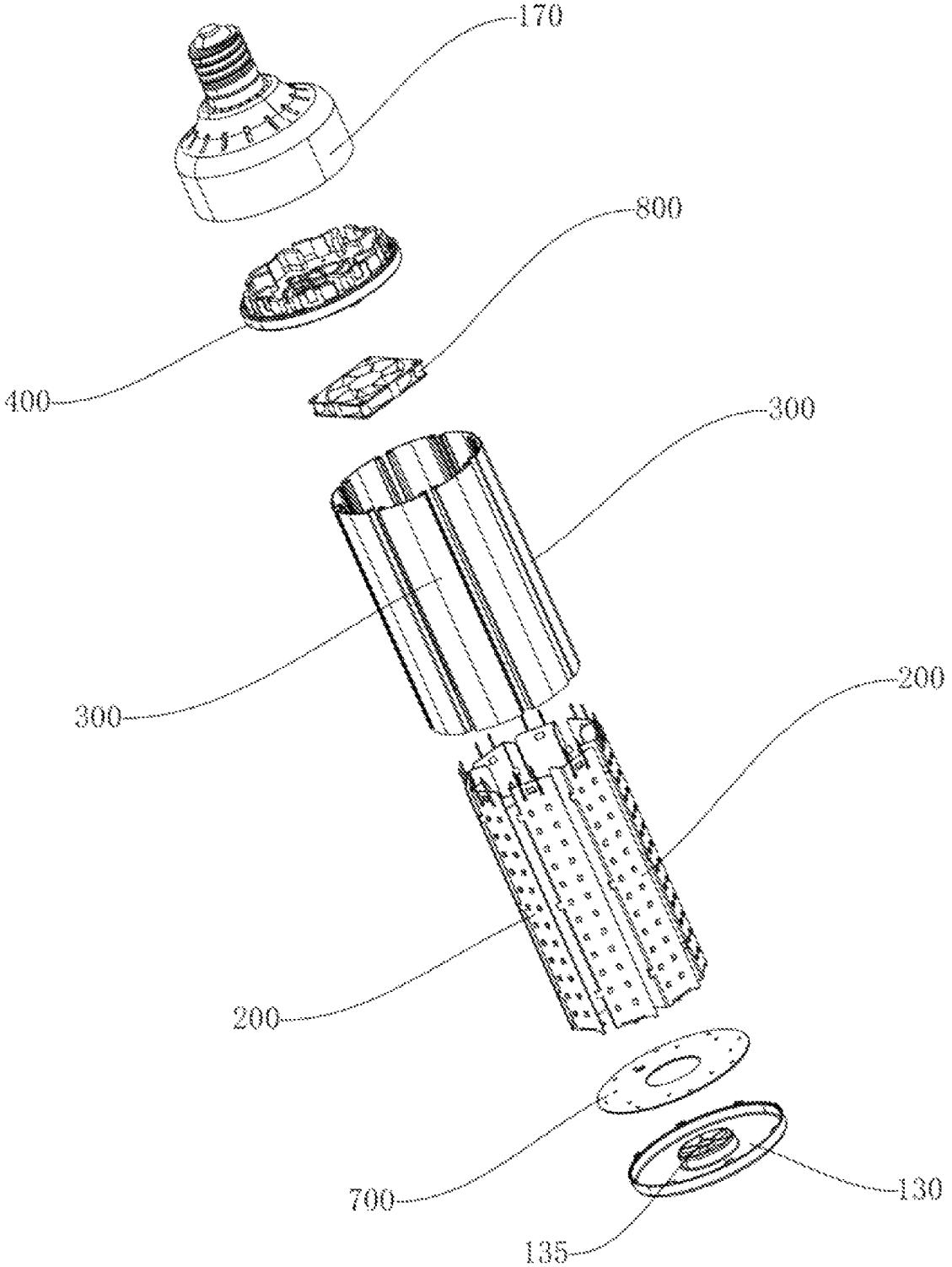
FIG. 2 is a schematic diagram of the decomposition of multi-angle light lamp shown in FIG. 1.

In some embodiments, refer to FIG. 2, lamp holder 170 is provided with a connecting seat 400, and the connecting seat 400 is provided with a power supply component, lamp board 200 is connected to the connecting seat 400, power supply component and lamp board 200 are respectively located on both sides of the connecting seat 400; the lamp board 200 is connected with an electric receiving part 270, the electric receiving part 270 passes through the connecting seat 400 and is connected with the power supply component. The connection between the power supply component and the electric receiving part 270 enables the power supply component to transmit power to the electric receiving part 270, so that the electric receiving part 270 can transmit power to the lamp board 200, and then provide power for the light of the lamp bead 210. The connecting seat 400 can not only provide the installation point for the power supply component, but also provide the connecting point for the lamp board 200, so that the lamp board 200 can be stably installed on the lamp holder 170 through the connecting seat 400.

Specifically, the lamp board 200 is provided with a clamping block. When the electric receiving part 270 passes through the connecting seat 400, the clamping block is clamped to the connecting seat 400. Of course, the lamp board 200 can also be connected to the connecting seat 400 in other ways, such as thread connection, etc. The specific implementation mode can be adjusted accordingly according to actual needs, and there is no restriction here.

Specifically, a power supply cavity is arranged between the lamp holder 170 and the connecting seat 400, and the power supply component is arranged in the power supply cavity.

Figure 3:
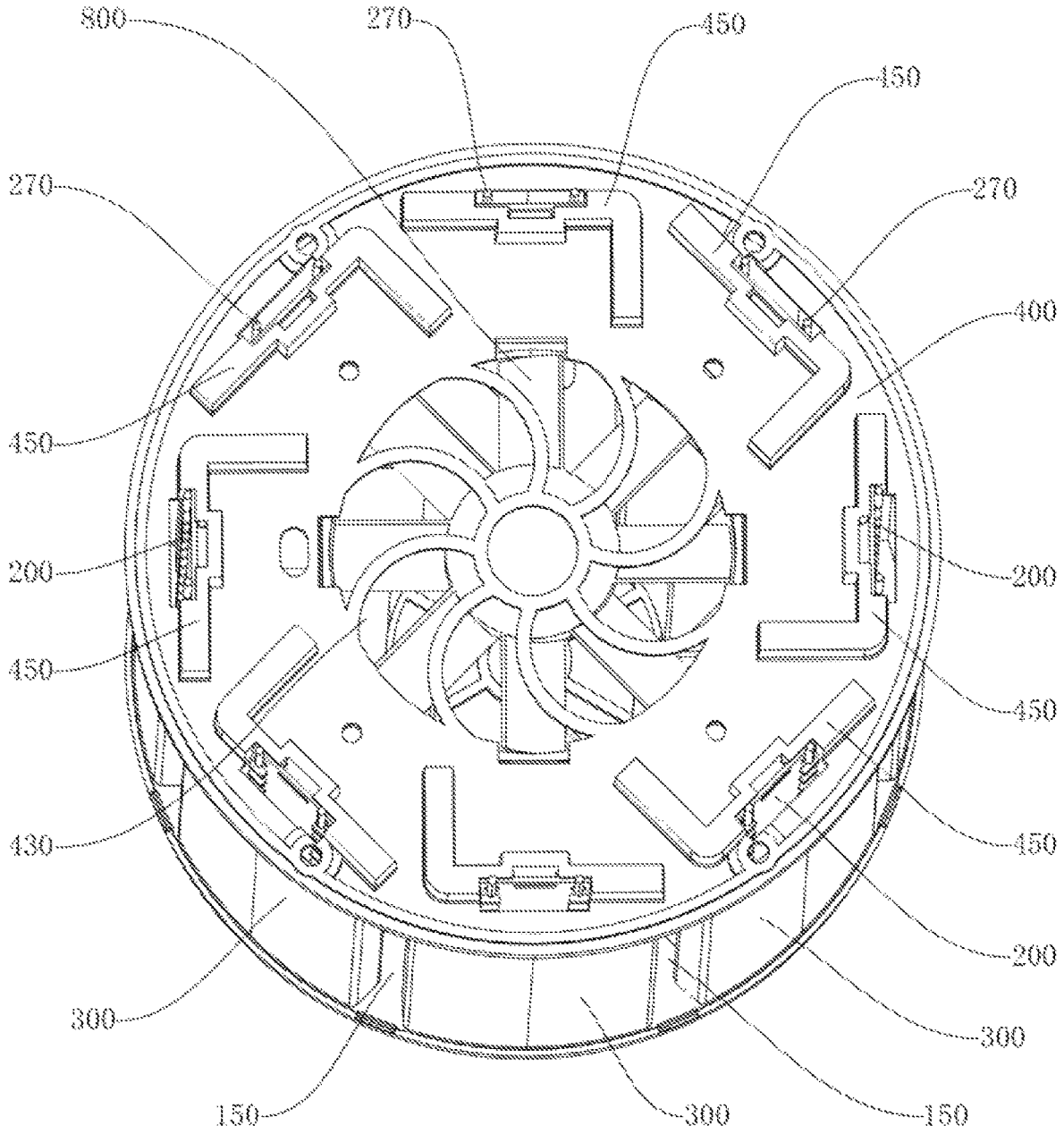
FIG. 3 is a schematic diagram of the connecting seat of the multi-angle light lamp shown in FIG. 1.

In some embodiments, referring to FIG. 3, the connecting seat 400 is provided with a positioning groove 450, the lamp board 200 and the heat dissipation part 250 are inserted into the positioning groove 450, and the electric receiving part 270 passes through the positioning groove 450. The positioning groove 450 can provide the connecting point for the lamp board 200, and the insertion and connection between the positioning groove 450 and the lamp board 200 also has the advantage of easy disassembly. The electric receiving part 270 can pass through the positioning groove 450, so it can ensure that the electric receiving part 270 can be stably connected with the power supply component, so that the lamp board 200 can get power for work.

In some embodiments, referring to FIG. 3, the connecting seat 400 is connected with fan 800, and the connecting seat 400 is provided with a hollow position 430, and the fan 800 is located in the lamp cavity. After the fan 800 is started, it can drive the air flow to accelerate the movement, so as to increase the speed of the air flow blowing on the heat dissipation part 250, thus effectively improving the heat dissipation effect of the heat dissipation part 250. The hollow position 430 can enable the fan 800 to drive the air on the connecting seat 400 to accelerate the flow, so it can also better disperse and discharge the heat on the connecting seat 400.

Specifically, the hollowed position 430 connects the power supply cavity and the lamp cavity.

In some embodiments, referring to FIG. 2, the end of the lamp board 200 away from the lamp holder 170 is connected with a base 130, and the base 130 is provided with an air vent 175, and a ventilation hole 135 is provided on the lamp holder 170, and both the air vent 175 and the ventilation hole 135 are communicated with the lamp cavity. After fan 800 is started, it will drive air flow into the ventilation hole 135 and pass through the hollow position 430 on the connecting seat 400, then flow into the lamp cavity and finally discharge from the air vent 175. By setting air vent 175 and ventilation hole 135, the flow direction of air can be effectively directed to flow in from the lamp holder 170 and out of the base 130. The flow of air will run through the connecting seat 400 and the whole lamp cavity, so it can maximize the heat that is brought away from the connecting seat 400 and the lamp cavity, so as to achieve better heat dissipation effect.

Specifically, the air vent 175 is opened in the middle of the base 130, and the ventilation hole 135 is multiple and distributed around the lamp holder 170.

Figure 4:
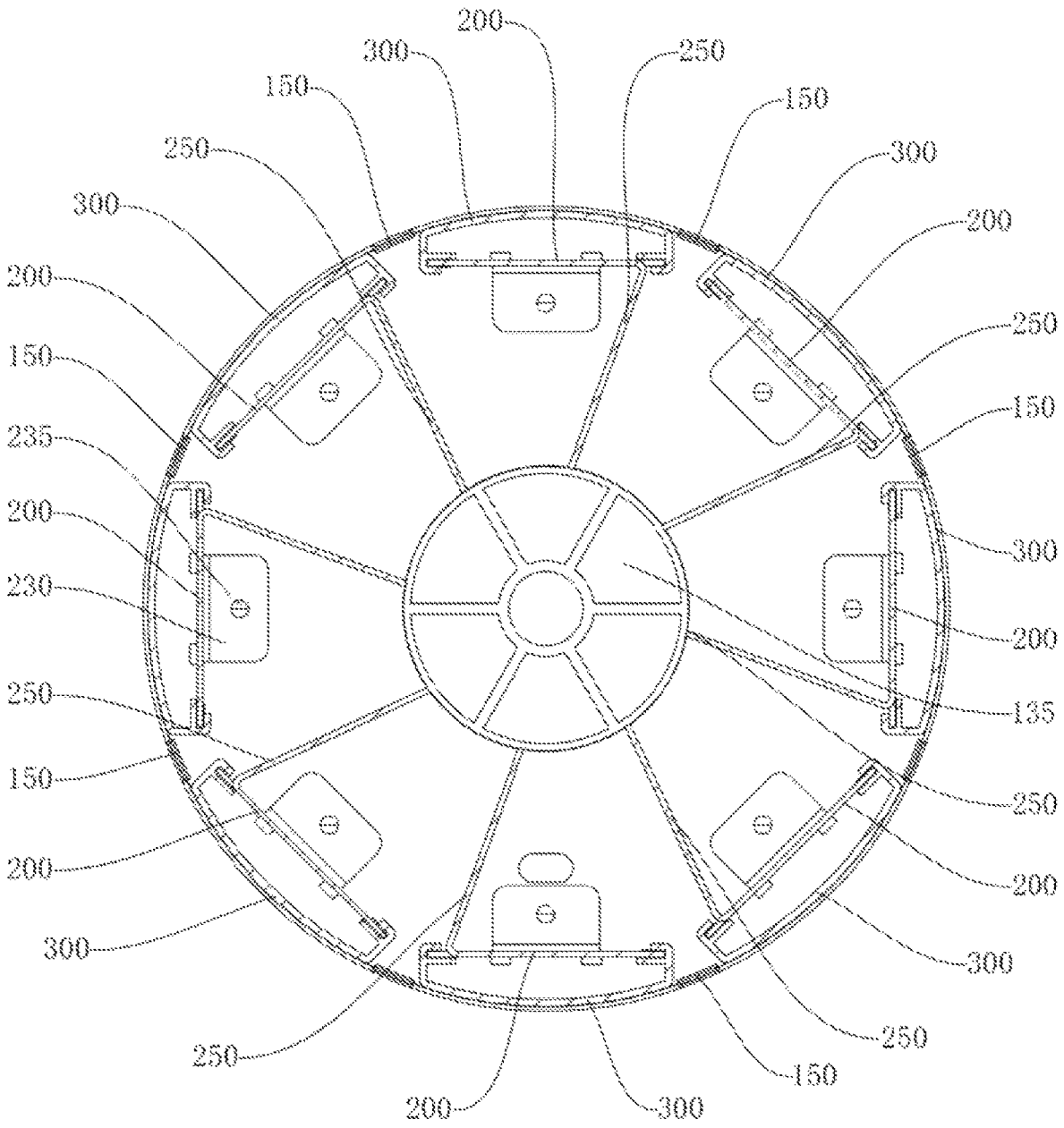
FIG. 4 is a schematic diagram of the section of multi-angle light lamp shown in FIG. 1.

In some embodiments, referring to FIG. 4, the base 130 is provided with a light source 700, the base 130 is a light transparent structure; the lamp bead 210 is arranged on the side of the lamp board 200, and the light source 700 can emit light in the direction to the one side of the lamp board 200. The lamp bead 210 can emit light to the side direction of the lamp board 200, while the lamp source 700 can emit light to the end direction of the lamp board 200. Therefore, under the joint action of lamp bead 210 and lamp source 700, the side direction and end direction of the lamp board 200 can be illuminated, so as to achieve a more comprehensive multi-angle lighting effect.

Predictably, lamp bead 210 and lamp source 700 can be LED sources as well as other luminescent components such as incandescent lamps. The specific implementation mode can be adjusted accordingly according to actual needs, and there is no restriction here.

In some embodiments, with reference to FIG. 2, the centers of the hollow position 430, fan 800, and air vent 175 are on the same line. The hollow position 430, the fan 800 and the air vent 175 are on the same straight line on the hollow position 430, making the airflow driven by the fan 800 in operation to flow in a straight line, and reduce the obstruction during the flow, thus increasing the flow velocity of air flow on the connecting seat 400 and in the lamp cavity, thus effectively increasing the efficiency of air flow to remove heat.

In some embodiments, referring to FIG. 4, a bending part 230 is provided at the end of the lamp board 200, and a screw 235 is provided between the bending part 230 and the base 130, and the two are connected by screw 235. The bending part 230 enables the lamp board 200 and the base 130 to be firmly connected by screw 235, so as to avoid the problem of shaking and loosening between the lamp board 200 and the base 130. In addition, the screw 235 connection also has the advantage of easy disassembly and assembly, thus facilitating maintenance and replacement.

What is claimed is:

1. A multi-angle lighting lamp, which is characterized in:

a lamp holder (170);

a plurality of lamp boards (200) are connected with the lamp holder (170), the plurality of lamp boards (200) are situated around a center of the lamp holder (170) and thus forming the lamp cavity, the lamp boards (200) are provided with the lamp bead (210) and heat dissipation part (250), and a heat dissipation part (250) is bent and extended into a lamp cavity relative to the lamp board (200);

a plurality of protective covers (300) is connected to the lamp board (200) one by one, and the protective covers (300) are covered on a plurality of lamp beads (210); there is a heat sink (150) between two adjacent protective covers (300), and the heat sinks (150) are communicated with the lamp cavity;

the protective cover (300) is provided with a connecting groove (350), and an edge of the lamp board (200) is arranged in the connecting groove (350);

a junction of the heat dissipation part (250) and the lamp board (200) is provided with a clamping platform (220), the edge of the lamp board (200) and the clamping platform (220) are connected to the connecting groove (350) one by one.

2. The multi-angle lighting lamp mentioned in claim 1 is characterized by:

the lamp holder (170) is provided with a connecting seat (400), the lamp board (200) is connected to the connecting seat (400), the lamp board (200) is located on a side of the connecting seat (400); the lamp board (200) is connected with an electric receiving part (270), the electric receiving part (270) passes through the connecting seat (400).

3. The multi-angle lighting lamp mentioned in claim 2 is characterized by:

the connecting seat (400) is provided with a positioning slot (450), the lamp board (200) and the heat dissipation part (250) are inserted in the positioning slot (450), the electric receiving part (270) passes through the positioning slot (450).

4. The multi-angle lighting lamp mentioned in claim 2 is characterized by:

the connecting seat (400) is connected with a fan (800), the connecting seat (400) is provided with a hollow position (430), the fan (800) is located in the lamp cavity.

5. The multi-angle lighting lamp mentioned in claim 4 is characterized by:

the end of the lamp board (200) far from the lamp holder (170) is connected with a base (130), the base (130) is provided with an air vent (175), and the lamp holder (170) is provided with a ventilation hole (135), and the air vent (175) and ventilation hole (135) are connected with the lamp cavity.

6. The multi-angle lighting lamp mentioned in claim 5 is characterized by:

the base (130) is provided with a light source (700), the base (130) is a light transparent structure; the lamp bead (210) is arranged on a side of the lamp board (200), and the light source (700) can emit light in a direction relative to the side of the lamp board (200).

7. The multi-angle lighting lamp mentioned in claim 5 is characterized by:

the hollow position (430), the fan (800) and a center of the air vent (175) are located on the same straight line.

8. The multi-angle lighting lamp mentioned in claim 5 is characterized by:

the end of the lamp board (200) is provided with a bending part (230), and a screw (235) is arranged between the bending part (230) and the base (130), and the bending part and the base are connected by the screw (235).

* * * * *